US006068155A

United States Patent [19]

Sicherman

[11] Patent Number: 6,068,155

[45] Date of Patent: May 30, 2000

[54] WASTE CONTAINER

[76] Inventor: Orna Sicherman, 40 Reines Street, Natania, Israel

[21] Appl. No.: 08/942,668

[22] Filed: Oct. 2, 1997

[51] Int. Cl.[7] ..... B65B 67/00

[52] U.S. Cl. ..... 220/495.06; 220/9.4; 220/495.08; 220/495.11; 220/908.1

[58] Field of Search ..... 220/495.08, 495.11, 220/9.4, 692, 908, 908.1, 737, 495.06

[56] References Cited

U.S. PATENT DOCUMENTS

| | | | |
|---|---|---|---|
| 2,678,764 | 5/1954 | Carlson | 220/495.11 X |
| 3,484,017 | 12/1969 | O'Donnell | 220/495.11 X |
| 3,815,778 | 6/1974 | Martin | 220/495.11 |
| 4,281,813 | 8/1981 | Garrity | 220/9.4 X |
| 4,457,483 | 7/1984 | Gagné | 220/495.11 X |
| 4,948,266 | 8/1990 | Bencic | 220/495.08 X |
| 4,979,547 | 12/1990 | Hoerner | 220/9.4 X |
| 5,056,679 | 10/1991 | Lonczak | 220/495.11 X |
| 5,598,942 | 2/1997 | Cowie | 220/495.08 |

*Primary Examiner*—Steven Pollard
*Attorney, Agent, or Firm*—Benjamin J. Barish

[57] ABSTRACT

A waste container includes a pliable plastic bag, and a rectangular sheet of stiff sheet material rolled and retained in the form of a cylinder open at its opposite ends and receiving the bag within it. The cylinder formed by the sheet encloses the bag, exposes the bottom of the bag enabling it to serve as the bottom of the waste container, and terminates short of the open top of the bag permitting a portion thereof to be turned out towards the bottom of the bag and to be draped over the corresponding open end of the cylinder. The described waste container also includes a second rectangular sheet of stiff sheet material rolled and retained in the form of a cylinder receiving the cylinder of the first-mentioned sheet, and firmly clamping the draped portion of the open top of the bag.

7 Claims, 1 Drawing Sheet

WASTE CONTAINER

FIELD AND BACKGROUND OF THE INVENTION

The present invention relates to waste containers, and particularly to waste containers which include a disposable bag that can be disposed when filled and replaced by an empty bag.

A large variety of waste container constructions have been described in the literature, as examplified by U.S. Pat. Nos. 2,006,705, 3,437,063, 3,762,599, 4,033,474, 4,450,974, 4,598,838, 4,890,652, 4,948,266, 4,979,574, 5,014,874, 5,160,063, 5,305,907, 5,318,821, 5,598,942. As a rule, the known constructions are relatively complicated to produce and/or to assemble, and/or occupy considerable volume during storage or shipping.

OBJECTS AND BRIEF SUMMARY OF THE INVENTION

An object of the present invention is to provide a waste container construction having advantages in the above respects.

According to one aspect of the present invention, there is provided a waste container, comprising: a pliable plastic bag having an open top and a closed bottom; and a rectangular sheet of stiff sheet material rolled and retained in the form of a cylinder open at its opposite ends and receiving the bag within it. The sheet has a length and width such that the cylinder formed by it encloses the bag, exposes the bottom of the bag enabling it to serve as the bottom of the waste container, and terminates short of the open top of the bag permitting a portion of the open top of the bag to be turned out towards the bottom of the bag and to be draped over the corresponding open end of the cylinder for retaining the bag in place.

According to further features in the described preferred embodiment, the opposite ends of the rectangular sheet include fastening strips for retaining the sheet, when rolled, in the form of a cylinder. Examples of such fastening strips are "Velcro" strips, and adhesive strips.

As will be described more particularly below, waste containers including the foregoing features may have a very simple, inexpensive construction which permits low-cost volume production. In addition, the unassembled parts of the container require very little volume for shipping or storage.

According to still further features in the preferred embodiment of the invention described below, the waste container further comprises; a second rectangular sheet of stiff sheet material rolled and retained in the form of a cylinder open at its opposite ends and receiving both the cylinder of the rolled first-mentioned sheet and the pliable plastic bag within the cylinder of the first-mentioned sheet. The second rectangular sheet is of a length such that the cylinder formed by it firmly clamps the draped portion of the open top of the bag between it and the cylinder formed by the first-mentioned sheet. The second rectangular sheet thus not only firmly clamps the bag, but also permits the outer surface of the waste container to be decorated as desired by merely printing the desired decorative pattern on the face of the second rectangular sheet to serve as the outer cylinder.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
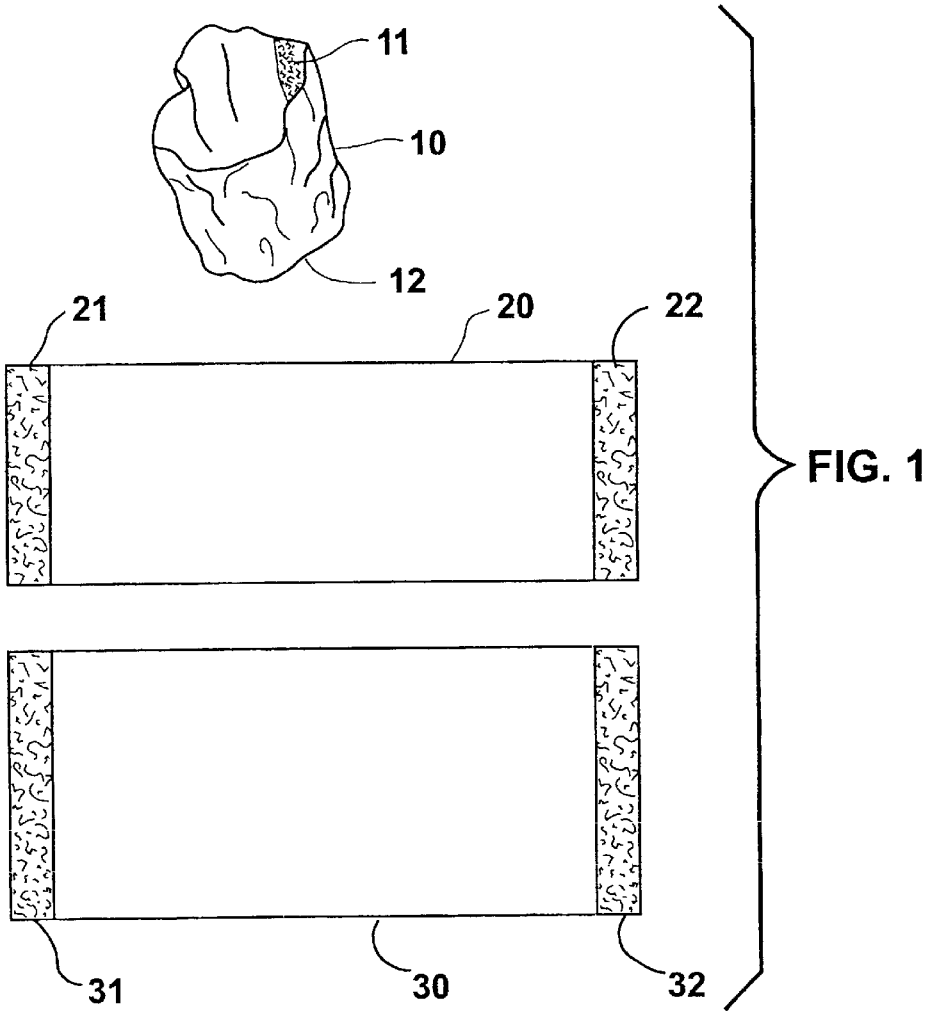
FIG. 1 illustrates the three main parts of a preferred form of waste container constructed in accordance with the present invention.

With reference first to FIG. 1, there is illustrated the three parts of the waste container, namely; a pliable plastic bag 10; a first rectangular sheet of stiff sheet material 20; and a second rectangular sheet of stiff sheet material 30.

The pliable plastic bag 10 may be of a conventional plastic bag construction such as now in widespread use, including an open top 11 and a closed bottom 12.

Figure 2A:
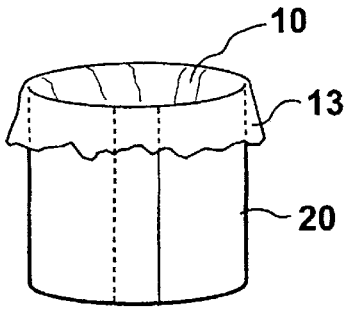
FIGS. 2*a,* 2*b* and 2*c* illustrate three stages in the assembly of the waste container from the three parts illustrated in FIG. 1.

Rectangular sheet 20 is of a stiff sheet material which enables it to be rolled and retained in the form of a cylinder, as shown at 20 in FIG. 2*a*. For example, rectangular sheet 20 may be of stiff cardboard sheet material, or of stiff plastic sheet material. Its opposite ends include fastening strips, as shown at 21 and 22, such as "Velcro" or of adhesive material, which retain the sheet in the form of a cylinder when rolled into that form.

Rectangular sheet 30 may be made of a similar stiff sheet material as sheet 20, e.g. of stiff cardboard or stiff plastic. It also includes fastening strips 31, 32, such as of "Velcro" or of adhesive material, which retain the sheet in a cylindrical form, as shown in 30 in FIG. 2*b,* when rolled into that form.

As will be described more particularly below, in assembling the waste container, rectangular sheet 20 is rolled into, and is retained in, the form of a cylinder open at its opposite ends for receiving the pliable plastic bag 10; and sheet 30 is also rolled into, and retained in, the form of a cylinder open at its opposite ends for receiving both the cylinder of sheet 20 and the pliable plastic bag 10 within it.

Figure 2B:
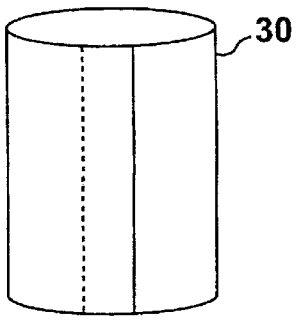
Figure 2C:
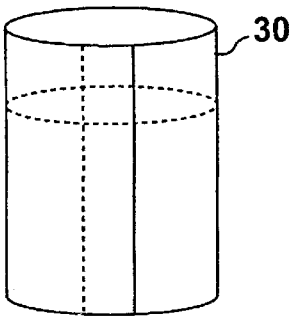

Rectangular sheet 30, is preferably of a width larger than that of sheet 20 such that the open end of the cylinder formed by sheet 30 projects upwardly past the open end of the cylinder formed by sheet 20, as shown in FIG. 2*c*. When so constructed, the upper portion of the cylinder formed by sheet 30 thus substantially hides from view the plastic bag 10, and particularly its draped-over portion 13 clamped between the cylinders of sheets 30 and 20, so that neither the plastic bag 10, nor the internal cylinder formed by sheet 20, is prominently viewable.

The manner of assembling the waste container from the three parts 10, 20, 30, is illustrated in FIGS. 2*a,* 2*b* and 2*c*. First, sheet 20 is rolled into a cylinder and retained in its cylindrical form by the fastener strips 21, 22 at its opposite ends; then bag 10 is inserted into the so-formed cylinder, such that the bottom 12 of the bag closes the bottom of the cylinder, and the top portion 13 of the bag is draped over the sides of the cylinder (FIG. 2*a*); and finally sheet 30, rolled and retained in its cylindrical form as shown in FIG. 2*b,* is inserted from its bottom through the top of cylinder 20 until the open bottom of cylinder 30 becomes flush with the open bottom of the cylinder formed by sheet 20.

When the parts are so assembled, the bag 10 is firmly clamped between the two cylinders 20, 30; the bottom 12 of the bag 10 serves as the bottom of the assembled waste container; and the top of cylinder 30 projects above bag 10 and the internal cylinder 20 so as to substantially obscure them from view. Since the outer surface of the cylinder formed by sheet 30 serves as the outer surface of the assembled waste container, the assembled waste container may be decorated as desired by merely printing the desired decoration on the outer surface of rectangular sheet 30.

Whenever bag 10 is full of waste, the cylinder formed by sheet 30 may be slipped off of the cylinder formed by sheet 20; the filled bag 10 may be removed and replaced by an empty bag 10; and the cylinder formed by sheet 30 may then be reapplied in the same manner as described above.

It will thus be seen that the described waste container can be produced in volume and at low cost, requires a minimum of volume in its non-assembled condition thereby saving valuable space during shipping or storage; permits easy replacement of filled bags; and enables any desired decorative pattern to be applied to the waste container by merely appropriately printing the pattern on one surface of rectangular sheet 30.

While the invention has been described with respect to one preferred embodiment, it will be appreciated that this is set forth merely for purposes of example, and that many variations may be made. For example, while it is preferable, it is not critical, that rectangular sheet 20 forming the inner cylinder include fastening strips at its opposite ends, as it could be retained in its cylindrical form by the cylinder produced by the outer rectangular sheet 30. Also, while it is preferable to have both sheets 20 and 30 form cylinders having smoothly curved surfaces, such cylinders could have flat sides (e.g., to be of square, pectagonal, or hexigonal configuration) by merely providing the appropriate fold lines transversely across the rectangular sheets. Further, while it is preferred that the cylinder formed by the outer sheet 30 projects upwardly past the cylinder formed by the internal sheet 20 so as to substantially obscure the bag from view, the cylinder formed by sheet 3 may be of the same height, or of even lower height, than that formed by the internal cylinder 20, which would thereby permit more of the bag 10 to be viewed. Also, while "Velcro" or adhesive strips are preferred for the fastening strips at the opposite ends of the two sheets 20, 30, other fastening means could be used, e.g. snap-fasteners, button-hole type fasteners, etc.

Many other variations, modifications and application of the invention will be apparent.

What is claimed is:

1. A waste container, comprising:

a pliable plastic bag having an open top and a closed bottom;

a first rectangular sheet of stiff sheet material rolled in the form of a cylinder open at its opposite ends and receiving said bag within it;

said sheet having a length and width such that the cylinder formed by it encloses the bag, exposes the bottom of the bag enabling the bottom to serve as the bottom of the waste container, and terminates short of the open top of the bag permitting a portion of the open top of the bag to be turned out towards the bottom of the bag and to be draped over the corresponding open end of the cylinder for retaining the bag in place;

and a second rectangular sheet of stiff sheet material rolled and retained in the form of a cylinder open at its opposite ends and receiving both said cylinder of the rolled first sheet and the pliable plastic bag within the cylinder of the first sheet;

said second rectangular sheet being of a length such that the cylinder formed by it firmly encloses the cylinder of said first sheet and firmly clamps said draped portion of the open top of the bag between it and the cylinder formed by said first sheet.

2. The waste container according to claim 1, wherein said second rectangular sheet is of a width larger than that of the first sheet such that the open end of the cylinder formed by said second rectangular sheet projects upwardly past the open end of the cylinder formed by said first sheet and the open top of the bag clamped between the cylinder formed of the two sheets.

3. The waste container according to claim 1, wherein the opposite ends of both said second rectangular sheets include fastening strips for retaining the respective sheet, when rolled, in the form of a cylinder.

4. The waste container according to claim 3, wherein said fastening strips are "Velcro" strips.

5. The waste container according to claim 3, wherein said fastening strips are adhesive strips.

6. The waste container according to claim 5, wherein both said rectangular sheets are made of stiff cardboard sheet material.

7. The waste container according to claim 1, wherein both said rectangular sheets are made of stiff plastic sheet material.

* * * * *